US006779588B1

(12) United States Patent
Good et al.

(10) Patent No.: US 6,779,588 B1
(45) Date of Patent: Aug. 24, 2004

(54) METHOD FOR FILLING A MOLD

(75) Inventors: Dave Good, Chelsea, MI (US); Robert L. Macheske, Tawas City, MI (US); Kenneth D. McKibben, Defiance, OH (US); Daniel D. Minor, Cadillac, MI (US); Tom Rozich, Au Gres, MI (US); Mark Salgat, Pinconning, MI (US); Brandon Schnettler, Au Gres, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 10/045,659

(22) Filed: Oct. 29, 2001

(51) Int. Cl.[7] ..... B22D 18/04; B22D 18/08; B22D 39/06

(52) U.S. Cl. ..... 164/457; 164/119; 164/133

(58) Field of Search ..... 164/457, 155.2, 164/4.1, 119, 306, 133, 135, 136, 335, 337

(56) References Cited

U.S. PATENT DOCUMENTS

| | | | | | |
|---|---|---|---|---|---|
| 3,844,331 | A | * | 10/1974 | Py et al. | 164/457 |
| 3,961,662 | A | * | 6/1976 | Balevski et al. | 164/457 |
| 4,585,050 | A | * | 4/1986 | Merrien et al. | 164/457 |
| 4,741,381 | A | * | 5/1988 | Nishida et al. | 164/457 |
| 5,178,203 | A | * | 1/1993 | Kuhn et al. | 164/147.1 |
| 5,215,141 | A | * | 6/1993 | Kuhn et al. | 164/457 |
| 5,309,975 | A | * | 5/1994 | Ohnishi et al. | 164/66.1 |
| 5,372,181 | A | * | 12/1994 | Watanabe et al. | 164/457 |
| 5,551,502 | A | * | 9/1996 | Matsubayashi et al. | 164/457 |
| 5,597,032 | A | * | 1/1997 | Merrien | 164/457 |
| 6,247,521 | B1 | * | 6/2001 | Kawai et al. | 164/457 |

FOREIGN PATENT DOCUMENTS

| | | | | |
|---|---|---|---|---|
| EP | 0 253 692 A1 | * | 1/1988 | B22D/18/08 |
| JP | 3-155447 | * | 7/1991 | B22D/18/04 |
| JP | 5-96356 | * | 4/1993 | B22D/18/06 |

* cited by examiner

*Primary Examiner*—Kiley Stona
*Assistant Examiner*—Kevin P. Kerns
(74) *Attorney, Agent, or Firm*—MacMillan, Sobanski & Todd, LLC

(57) ABSTRACT

A mold of a casting machine is filled to make a cast article. The method includes providing a molten metal to a casting chamber in fluid communication with the mold, the casting chamber having a supply conduit for introducing a gas into the casting chamber, and the casting chamber having an evacuation conduit for delivering the molten metal from the casting chamber to the mold. The method also includes controlling the filling of the mold during a first time interval by delivering the molten metal from the casting chamber to the mold at a first rate. The method further includes controlling the filling of the mold during a second time interval by delivering the molten metal from the casting chamber to the mold at a second rate. The filling of the mold decelerates from the first rate to the second rate and the second rate does not exceed the first rate.

9 Claims, 5 Drawing Sheets

METHOD FOR FILLING A MOLD

BACKGROUND OF THE INVENTION

This invention relates in general to a casting machine and in particular to a method of filling a mold cavity of such a casting machine to produce a cast article. Pressure pouring of the molten metal from a furnace to fill a mold cavity has been used for several decades despite a number of problems. At room temperature, the metal is solid and become fluid when melted with sufficient heat. When the metal becomes a fluid, it can become difficult to manage as it begins to assume fluid dynamic characteristics.

It is known to use a low pressure countergravity casting apparatus to cast molten metal into a mold. One example of such an apparatus is described in U.S. Pat. No. 5,215,141. Basically, in a low pressure countergravity casting apparatus, molten metal is supplied to a machine furnace. The machine furnace includes a supply conduit for introducing a gas under pressure into the machine furnace. As the gas is introduced into the machine furnace, the molten metal in the machine furnace is forced through a submerged feed tube, or evacuation conduit, into the mold. The evacuation conduit is commonly referred to as a stalk tube. The mold receives the molten metal through holes in the bottom of the mold. The molten metal in the mold cooling and hardening produces a cast article. A controller is used to adjust the pressure at which the gas is being introduced into the machine furnace. Thus, it can be seen that the machine furnace, the casting apparatus, and the mold are in fluid communication.

One problem in managing the molten metal has been delivering it to the casting apparatus such that the molten metal does not produce a porous cast article. Pores can be formed in the cast article when the molten metal used to make the cast article encounters "surface turbulence" during the filling of the mold. Turbulence can cause encapsulation of air into the molten metal and produce undesirable oxides. The oxides are also produced as an encapsulated skin that can weaken the affected portion of the cast article. Thus, it would be desirable to provide an improved method for filling the mold cavity of the casting machine that reduces the amount of turbulence produced during the casting process.

SUMMARY OF THE INVENTION

This invention relates to a method for filling a mold of a casting machine to make a cast article. The method includes providing a molten metal to a casting chamber in fluid communication with the mold, the casting chamber having a supply conduit for introducing a gas into the casting chamber, and the casting chamber having an evacuation conduit for delivering the molten metal from the casting chamber to the mold. The method also includes controlling the filling of the mold during a first time interval by delivering the molten metal from the casting chamber to the mold at a first rate. The method further includes controlling the filling of the mold during a second time interval by delivering the molten metal from the casting chamber to the mold at a second rate. The filling of the mold decelerates from the first rate to the second rate and the second rate does not exceed the first rate.

This invention also pertains to a method for filling a mold to make a cast article. The method includes providing a molten metal to a casting chamber, the casting chamber having a supply conduit for introducing a gas into the casting chamber, and the casting chamber having an evacuation conduit for delivering the molten metal from the casting chamber to the mold. The method also includes providing a transducer and a controller. The method further includes during a first time interval controlling the filling of the mold by introducing the gas into the casting chamber at a first rate, and during a second time interval controlling the filling of the mold by introducing the gas into the casting chamber at a second rate. The transducer sends a signal representative of the pressure in the casting chamber and the controller changes the filling of the mold from the first rate to the second rate.

This invention also pertains to a method for filling a mold to make a cast article. The method includes providing a molten metal to a casting chamber, the casting chamber having a supply conduit for introducing a gas into the casting chamber, and the casting chamber having an evacuation conduit for delivering the molten metal from the casting chamber to the mold. The method also includes providing a desired fill profile for delivering the molten metal from the casting chamber to the mold. The method further includes detecting the pressure in the casting chamber and providing a controller and sending a signal representative of the pressure in the casting chamber to the controller. The method also includes changing the desired fill profile based upon the signal representative of the pressure in the casting chamber.

Other advantages of this invention will become apparent to those skilled in the art from the following detailed description of the preferred embodiment, when read in light of the accompanying drawings.

DETAILED DESCRIPTION OF THE PREFERRED EMBODIMENT

Molten metal may be added to a mold at differing rates at differing sections thereof in the production of a cast article. Economic considerations suggest that the mold should be filled with molten metal at a relatively quick rate so as to produce a cast article at a sufficient production rate. However, the filling of the mold too quickly can lead to a weaker and more porous section of the cast article, as described herein. Therefore structural considerations call for the mold to be filled at a selected rate of fill which is effective to produce a sufficiently strong and less porous section of the cast article. Therefore, the cast article may be filled with the molten metal at a selected first "slower" rate at those sections of the cast article where structural integrity is most crucial, such as those portions of the cast article that will bear more weight during use, and filled at a selected second "quicker" rate at those sections of the cast article where excessive turbulence does not occur. The selected first and second rates are dependent upon the particular geometry and structural requirements of the particular cast article that is to be produced.

Figure 1:
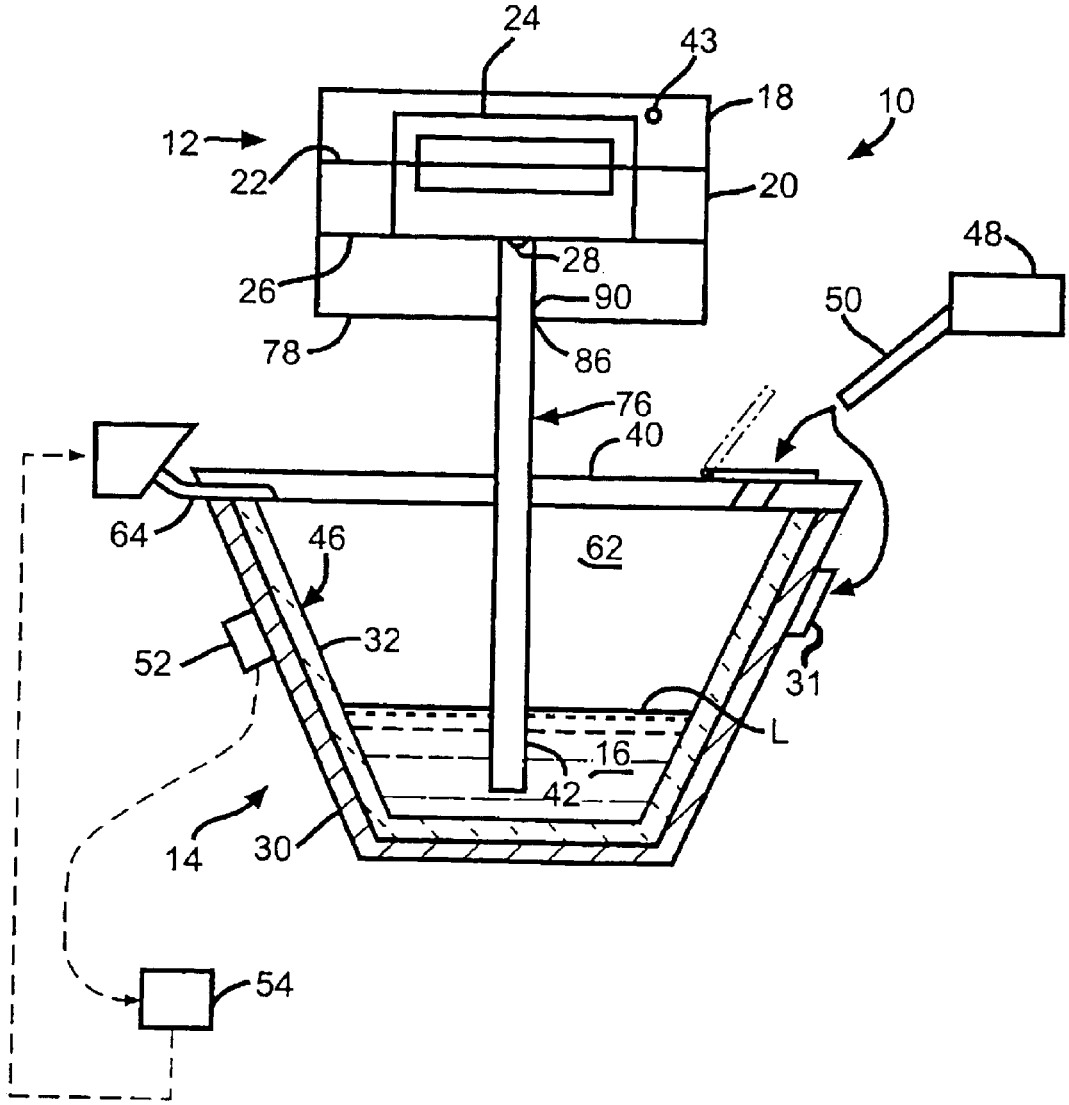
FIG.1 PRIOR ART
FIG. 1 is a schematic elevational cross-sectional view of a prior art casting apparatus.

Referring now to FIG. 1, there is illustrated a prior art low pressure countergravity casting apparatus, indicated generally at 10, which can be used in accordance with the teachings of the present invention. Although this invention will be described and illustrated in conjunction with the particular low pressure countergravity casting apparatus 10 disclosed herein, it will be appreciated that this invention may be used in conjunction with other types of casting apparatus. The general structure and operation of the low pressure countergravity casting apparatus 10 is conventional in the art. Thus, only those portions of the low pressure countergravity casting apparatus 10 which are necessary for a full understanding of this invention will be explained and illustrated in detail.

The illustrated low pressure countergravity casting apparatus 10 includes a mold 12 and a reservoir 14. The casting apparatus includes a first supply port 50 for supplying a molten metal 16 to a casting chamber 46, and a second supply port 64 for supplying a fluid to the casting chamber 46. The casting chamber 46 contains the molten metal 16. The molten metal 16 may be molten aluminum or any other suitable type of metal. The casting chamber 46 also contains the fluid, preferably under pressure. The fluid may be air, nitrogen gas, or any other suitable compressible or non-compressible fluid.

The illustrated casting chamber 46 is housed in the reservoir 14. The reservoir 14 is preferably a crucible furnace. The illustrated reservoir 14 includes an outer shell 30, which is preferably lined with an inner insulating refractory liner 32. The outer shell 30 can be metal or any other suitable material. The refractory liner 32 supports the casting chamber 46 therein. In the illustrated embodiment, an insulated cover 40 is positioned to assist in maintaining the molten metal 16 to within a desired temperature range in the casting chamber 46. The cover 40 also preferably seals the casting chamber 46 air tight for a purpose to be discussed below.

The reservoir 14 may also include an access opening or door 31. The door 31 is optional and may be positioned to extend into the casting chamber 46. The door 31 is positioned for service and repair to the casting chamber 46. In order to best maintain the molten metal 16 and fluid in the casting chamber 46 under pressure, the door 31 preferably forms a relatively air tight seal with the reservoir 14. The casting chamber 46 is operatively coupled to a metal supply furnace 48, preferably by a first supply port 50 positioned to feed the furnace 48.

The first supply port 50 is a supply trough. The first supply port 50 is preferably insulated to prevent heat loss from the molten metal 16 being supplied by the metal supply furnace 48 to the reservoir 14. The molten metal 16 is preferably maintained at a generally consistent level in the casting chamber 46, as indicated by line L. There is preferably an enclosed fluid space 62 between the molten metal 16 and the cover 40 of the casting chamber 46. The second supply port 64 communicates with the fluid space 62 to supply the fluid to the casting chamber 46.

The mold 12 of the casting apparatus 10 is preferably situated above the reservoir 14. The mold 12 is constructed from conventional foundry mold 12 materials and according to conventional practices in the art. The illustrated mold 12 includes an upper mold half or cope 18 which is joined to a lower mold half or drag 20 along a parting line 22. The upper mold half 18 and the lower mold half 20 cooperate to define a mold cavity 24. A suitable metal die, or other type of die, may also be used instead of the mold 12 to provide the mold cavity 24.

The molten metal 16 is supplied to the mold 12 as described herein to produce a cast article (not shown) in the mold cavity 24. The cast article is preferably a vehicle component, although not so limited. Non-limiting examples of the cast article include a vehicle wheel, household goods, vehicle workpieces and the like. It should be understood that the cast article is preferably about the same shape and about the same contour as the mold cavity 24. Also, it should be understood that the mold cavity 24 is preferably an air tight cavity, and that the molten metal 16 which enters the mold 12 is contained within the mold cavity 24. The mold cavity 24 may be vented.

The casting apparatus 10 includes one or more inlet feed gates 28 (only one of such inlet feed gates 28 illustrated in FIG. 1). The inlet feed gates 28 extend generally upwardly from a bottom side 26 of the mold 12 and are operative to establish fluid communication between the mold cavity 24 and the bottom side 26 of the mold 12. The inlet feed gates 28 of the mold 12 are supplied with the molten metal 16 from the casting chamber 46 through a feed tube 76. The inlet feed gates 28 are provided to aid in further processing of the cast article after the cast article has sufficiently cooled.

The illustrated feed tube 76 extends generally vertically upwardly from the casting chamber 46 of the casting apparatus 10. In the illustrated embodiment, the casting apparatus 10 includes a suitable distribution vessel 78 provided between the feed tube 76 and the mold 12. The feed tube 76 and distribution vessel 78 are preferably heated by appropriate means and/or insulated to assist in maintaining the molten metal 16 to within the desired temperature range. The distribution vessel 78 preferably includes refractory walls. The feed tube 76 includes a lower bottom end 42 disposed in the casting chamber 46. The illustrated feed tube 76 extends preferably vertically upwardly from the casting chamber 46 and is coupled to a single bottom inlet 86 of the distribution vessel 78. The feed tube 76 is operative to establish fluid communication between the mold 12 and the casting chamber 46. Alternatively, the distribution vessel 78 can be eliminated or configured other than illustrated if desired.

In the illustrated embodiment, the mold 12 is supported above the crucible furnace 14. The distribution vessel 78 is preferably fabricated of refractory material and has one or more distribution ports 90 formed therethrough. The distribution ports 90 preferably correspond in number, arrangement and approximate size to the inlet feed gates 28 of the mold 12. The particular size, number and arrangement of the inlet feed gates 28 and distribution ports 90 are largely dependent on the configuration of the cavity 24 and are selected so as to deliver and distribute the molten metal 16 into the mold cavity 24 at a desired supply fill rate.

To supply the molten metal 16 from the casting chamber 46 into the mold 12, a controlled amount of the fluid is supplied through the second supply port 64, which in turn causes the molten metal 16 to move upwardly through the feed tube 76, through the distribution vessel 78, and into the mold 12. The fluid is preferably supplied under pressure, and will be presumed to be so supplied in this application unless otherwise indicated. The level of the molten metal 16 in the cavity 24 is proportional to the level of the molten metal 16 in the casting chamber 46, the amount of pressure being exerted on the molten metal 16 in the casting chamber 46, and the density of the molten metal 16, as well as other variables. It should be understood that by selectively controlling the amount of pressure in the casting chamber 46, the rate at which molten metal 16 is supplied to the mold 12 is selectively controlled.

As the molten metal 16 fills the mold cavity 24, the molten metal 16 cools and hardens. In the illustrated embodiment, a cooling means 43 is preferably provided proximate the mold cavity 24 to facilitate cooling. The cooling means 43 is preferably provided in the upper mold half 18 of the mold 12. As the molten metal 16 cools in the mold cavity 24, shrinkage occurs. Thus, as the molten metal 16 shrinks and hardens, additional molten metal 16 is preferably added to the mold cavity 24 to fill the mold cavity 24 to a desired level in order to produce the cast article.

The casting apparatus 10 preferably includes a transducer 52. The transducer 52 is operative to detect the pressure in the casting chamber 46 and those portions of the casting apparatus 10 in fluid communication with the casting chamber 46. The transducer 52 is operative to produce a pressure signal representative of the pressure in the casting chamber 46 and those portions of the casting apparatus 10 in fluid communication with the casting chamber 46. The casting apparatus 10 preferably includes a controller 54. The controller 54 is operatively connected to the transducer 52 so as to receive the pressure signal from the transducer 52. The controller 54 is also operative to regulate the pressure in the casting chamber 46 and those portions of the casting apparatus 10 in fluid communication with the casting chamber 46, as further described herein. The controller 54 regulates the pressure in the casting chamber 46 and those portions of the casting apparatus 10 in fluid communication with the casting chamber 46 by any suitable means. For example, the controller 54 can be operatively connected to the second supply port 64 so as to regulate the supply of the fluid through the second supply port 64 to the casting chamber 46. The casting apparatus 10 may also be employed to provide a desired fill profile, or command line or curve, as further described herein.

Figure 2:
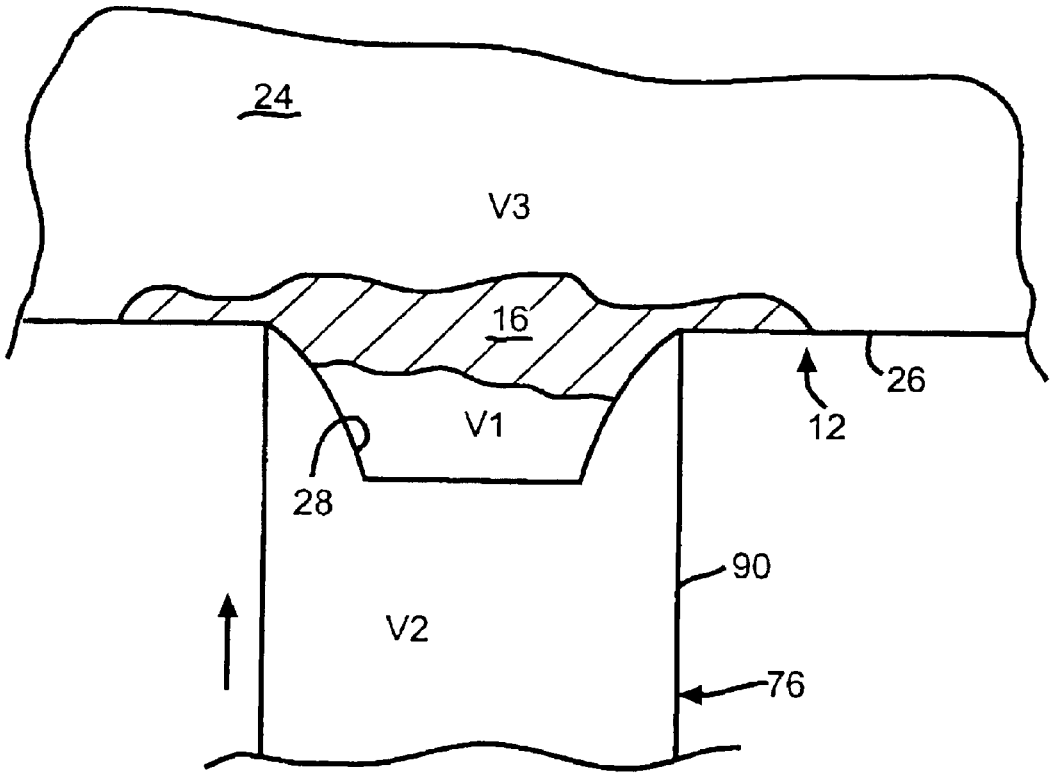
FIG. 2 PRIOR ART
FIG. 2 is a sectional view of a portion of the casting apparatus illustrated in FIG. 1.

Referring now to prior art FIG. 2, the inlet feed gate 28, the distribution port 90, and the adjacent mold cavity 24 are illustrated containing the molten metal 16. It will be appreciated that the volume V1 of the molten metal 16 in the inlet feed gate 28 is less than the volume V2 of the molten metal 16 in the distribution port 90 and the volume V3 of the molten metal 16 in the mold cavity 24. Thus, as the molten metal 16 passes through the inlet feed gate 28 from the port 90 into the mold cavity 24, turbulence can be produced.

Figure 3:
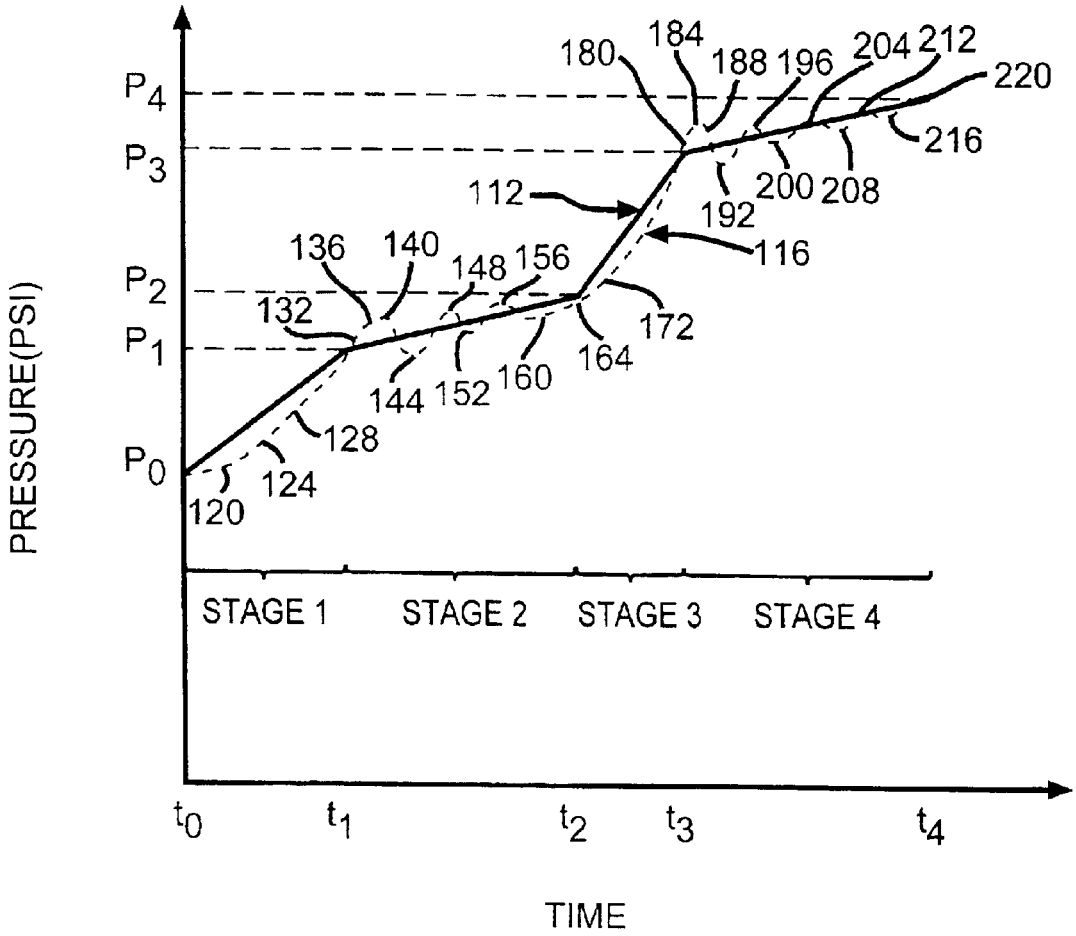
FIG. 3 PRIOR ART
FIG. 3 is a graph illustrating a prior art filling method used to fill the casting apparatus illustrated in FIG. 1.

Referring now to FIG. 3, there is illustrated a prior art desired fill profile, indicated generally at 112. The desired fill profile 112, illustrated in solid line, is a command line or curve and preferably represents the method in which the molten metal 16 theoretically is supplied from the supply furnace 48, to the casting chamber 46, the feed tube 76, and into the mold cavity 24 of the mold 12 (illustrated in FIGS. 1 and 2). The prior art desired fill profile 112 is preferably controlled by the controller 54. The illustrated prior art desired fill profile 112 illustrates the desired amounts of the molten metal 16 to be delivered to the mold 12 produce the cast article. The control variable in the prior art fill profile is the pressure from the fluid that is added to the casting chamber 46 through the second supply port 64. Because the molten metal 16 rises in the mold 12 as the fluid is added to the casting chamber 46, the amount of pressure applied to the molten metal 16 corresponds to the length the molten metal 16 travels into the mold 12. Thus, it will be appreciated that the near maximum amount of pressure applied to the molten metal 16 in the casting chamber 46 will occur when the mold 12 is relatively full of molten metal 16, and the cast article in the mold 12 is near its maximum size. Additional pressure may be applied to the molten metal 16 in the casting chamber 46 to accommodate shrinkage of the molten metal 16 as it cools.

The illustrated prior art desired fill profile 112 is divided into four different filling stages, illustrated as stage 1, stage 2, stage 3, and stage 4. The prior art desired fill profile 112 may include any suitable number of stages. The filling stages 1–4 are associated with four time intervals, $t_0$ to $t_1$, $t_1$ to $t_2$, $t_2$ to $t_3$, and $t_3$ to $t_4$, respectfully, and with four pressure change intervals, p0 to p1, p1 to p2, p2 to p3 and p3 to p4. It should be noted that the prior art desired fill profile 112 changes from stage 1 to stage 2, from stage 2 to stage 3, and from stage 3 to stage 4. The prior art desired fill profile 112 includes four substantially straight intersection line sections to represent stage 1, stage 2, stage 3, and stage 4. It will be appreciated that the pressure increases at all portions of the illustrated prior art desired fill profile 112 from $t_0$ to $t_4$ for the desired fill profile 112 shown. Another prior art desired fill profile 112 may include one or more portions where the pressure remains about constant or decreases. It will also be appreciated that the pressure increases faster during stages 1 and 3 as compared to stages 2 and 4.

Pressure $P_0$ is representative of the pressure at which the molten metal 16 is optimally delivered to the feed tube 76. Pressure $P_1$ is representative of the pressure at which the molten metal 16 is optimally delivered proximate the inlet feed gate 28. $P_2$ is representative of the pressure at which the molten metal 16 is optimally delivered to the mold cavity 24. $P_3$ is representative of the pressure at which the molten metal 16 is optimally delivered to the mold cavity 24 when the cast article is cooling. $P_4$ is representative of the pressure at the termination of the desired fill profile 112. Likewise, $P_1$, $P_2$, and $P_3$ are the pressures at those portions of the prior art desired fill profile 112 where the rates of the pressure change. Prior art FIG. 3 also illustrates a prior art actual fill profile, indicated generally at 116. The prior art actual fill profile 116 generally corresponds to the amount of the molten metal 16 in the mold 12 to produce the cast article.

The prior art actual fill profile 116 is divided into four different filling stages, illustrated as stage 1, stage 2, stage 3, and stage 4. The prior art actual fill profile 116 may include any suitable number of stages. The filling stages 1–4 are associated with four time intervals, $t_0$ to $t_1$, $t_1$ to $t_2$, $t_2$ to $t_3$, and $t_3$ to $t_4$, respectfully, and with four pressure change intervals, p0 to p1, p1 to p2, p2 to p3 and p3 to p4. It should be noted that the prior art actual fill profile 116 changes from stage 1 to stage 2, from stage 2 to stage 3, and from stage 3 to stage 4.

It will be appreciated that the pressure $P_0$ of the prior art desired fill profile 112 and the pressure $P_0$ of the prior art actual fill profile 116 are about equal. However, it will also be appreciated that, at about a point 120, the pressure of the prior art actual fill profile 116 is less than the pressure of the prior art fill profile 112 at that time. The controller 54 compensates at about a point 124 by increasing the amount of fluid being supplied to the casting chamber 46. Thus, at about a point 128, the amount of fluid being supplied to the casting chamber 46 increases more quickly compared to the point 120. The amount of fluid being added to the casting chamber 46 is adjusted by the controller 54 such that the pressure of the prior art actual fill profile 116 is about the same as the pressure of the prior art desired fill profile 112 at the end of stage 1 at time $t_1$.

It will be appreciated that as the prior art actual fill profile 116 begins stage 2 approximately after time $t_1$, the prior art actual fill profile 116 "overshoots" the prior art desired fill profile 112 at a point 132 of the prior art actual fill profile 116. The amount of pressure that is added to the casting chamber 46 is increased more slowly by the controller 54 at about time $t_1$. The amount of the molten metal 16 that is being added to the mold 12 does not decrease immediately. Indeed, at a point 136 of the prior art actual fill profile 116, the amount of the molten metal 16 flowing into the mold 12 is more than the amount at the point 132. At about a point 140, the amount of the molten metal 16 being added to the mold 12 decreases until it reaches a trough at about a point 144. The point 144 is below the prior art desired fill profile 112. Between about the point 140 and about a point 144, the level of the molten metal 16 in the mold 12 is dropping, which is undesirable. Desirably, the level of the molten metal 16 in the mold 12 does not drop, but instead continues to gradually and smoothly rise to produce a more desirable cast article.

At about the point 144, the molten metal 16 in the mold 12 "bounces" and creates turbulence in the molten metal 16 in the mold 12, (as also illustrated in prior art FIG. 2). The molten metal 16 in the mold 12 reaches a relative peak at about a point 148 of the prior art actual fill profile 116, then drops to a trough at about a point 152. At about the point 152, the molten metal 16 in the mold 12 "bounces," and creates undesirable turbulence in the molten metal 16 in the mold 12. The molten metal 16 in the mold 12 reaches a relative peak at about a point 156 of the prior art actual fill profile 116, then drops to a trough at about a point 160. At about the point 160, the molten metal 16 in the mold 12 "bounces," and creates turbulence in the molten metal 16 in the mold 12. It should be noted that, though three troughs, the point 144, the point 152, and the point 160 are shown and discussed, the actual fill profile 116 may include a different number of troughs in stage 2.

It will be appreciated that as the illustrated prior art actual fill profile 116 begins stage 3 at about the time $t_2$, the prior art actual fill profile 116 about approximates the prior art desired fill profile 112 at about a point 164 of the actual fill profile 116. At about a point 172 of the prior art desired fill profile 112, the pressure of the prior art actual fill profile 116 is less than that of the prior art desired fill profile 112. The controller 54 compensates at about a point 172 by increasing the amount of fluid being added to the casting chamber 46. The amount of fluid being added to the casting chamber 46 is adjusted by the controller 54 such that the pressure of the prior art actual fill profile 116 is about the same as the pressure of the prior art desired fill profile 112 at the end of stage 3 at time $t_3$.

It will be appreciated that as the illustrated prior art actual fill profile 116 begins stage 4 approximately after time $t_3$, the prior art actual fill profile "overshoots" the desired fill profile 112 at a point 180 of the prior art actual fill profile 116. Thus, the controller 54 is operative to decrease the amount of fluid that is being added to the casting chamber 46 approximately after time $t_3$. But, the amount of molten metal 16 that is being added to the mold 12 does not decrease immediately due to the momentum of the molten metal 16. Thus, at a point 184 of the prior art actual fill profile 116, the amount of the molten metal 16 flowing into the mold 12 is more than at the point 180.

At about a point 188, the amount of the molten metal 16 being added to the mold 12 decreases. The amount of the molten metal 16 being added to the mold 12 decreases until it reaches a trough at about a point 192. The point 192 is below the desired fill profile 112. Between the point 188 and the point 192, the level of the molten metal 16 is dropping in the mold 12, which is undesirable. Desirably, the level of the molten metal 16 in the mold 12 does not drop, but instead continues to gradually and smoothly rise to produce a more desirable cast article. At about the point 192, the molten metal 16 in the mold 12 "bounces," and creates turbulence in the molten metal 16 in the mold 12. The molten metal 16 in the mold 12 reaches a relative peak at about a point 196 of the prior art actual fill profile 116, then drops to a trough at about a point 200. At the point 200, the molten metal 16 in the mold 12 "bounces" and creates turbulence in the molten metal 16 in the mold 12.

The molten metal 16 in the mold 12 reaches a peak at about a point 204 of the prior art actual fill profile 116, then drops to a trough at a point 208. At about the point 208, the molten metal 16 in the mold 12 "bounces" and creates turbulence in the molten metal 16 in the mold 12. The molten metal 16 in the mold 12 reaches a peak at about a point 212 of the prior art actual fill profile 116, then drops to a trough at about a point 216. At about the point 216, the molten metal 16 in the mold 12 "bounces" and creates turbulence in the molten metal 16 in the mold 12.

At about a point 220, the maximum amount of metal to be added to the mold 12 is reached. It should be noted that, though four troughs, the point 192, the point 200, and the point 208, and the point 216 are shown and discussed, the prior art actual fill profile 116 may include a different number of troughs in stage 4. The structure of the casting apparatus 10 and the method for filling the casting apparatus 10 thus far described is conventional in the art.

Figure 4:
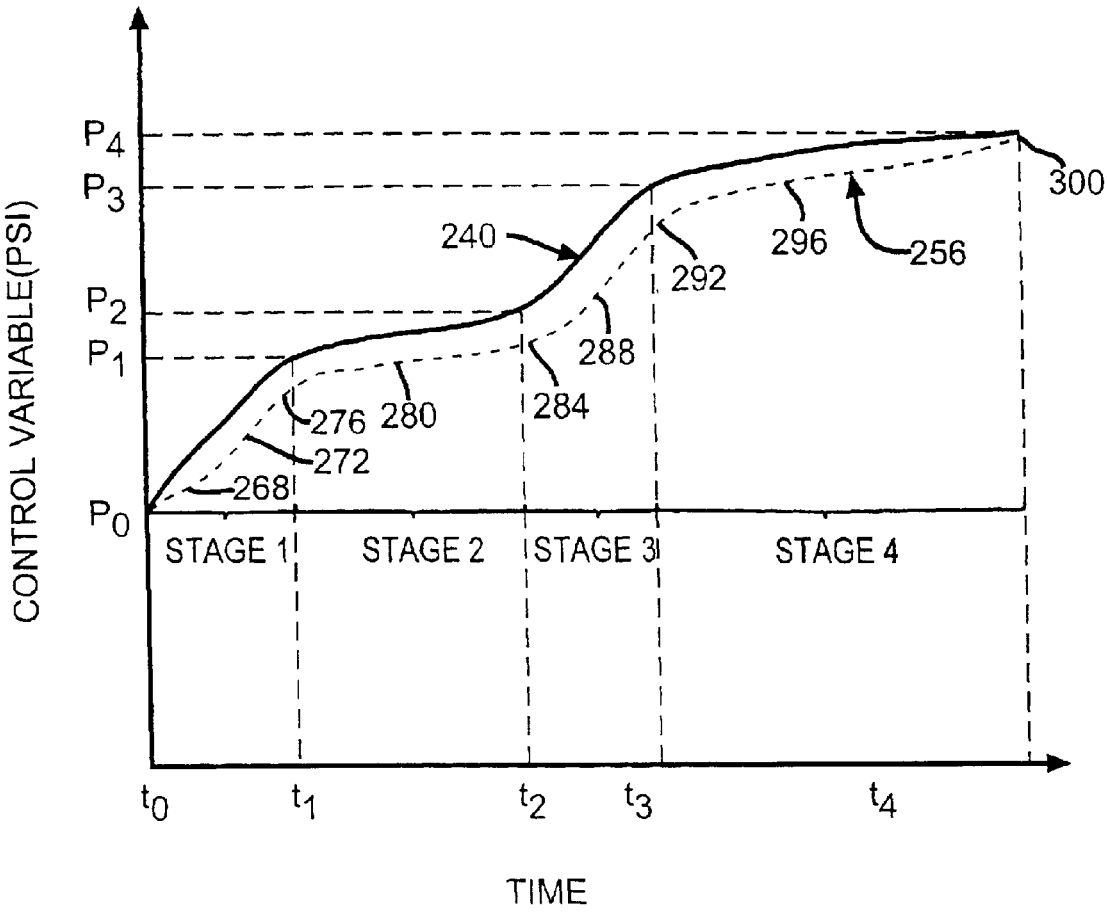
FIG. 4 is a graph illustrating a filling method according to the present invention, which can be used to fill the prior art casting apparatus illustrated in FIG. 1.

Referring now to FIG. 4, there is illustrated a desired fill profile, indicated generally at 240, in accordance with the present invention. The desired fill profile 240 is illustrated in solid line. The desired fill profile 240 is a command line or curve, and preferably represents the way in which the molten metal 16 theoretically fills the casting chamber 46, the feed tube 76, and the mold cavity 24 of the mold 12. The desired fill profile 240 is preferably generated by the controller 54. The illustrated desired fill profile 240 represents the desired rates at which the mold 12 will be filled with molten metal 16 to produce the cast article. The control variable is the pressure from the fluid that is added to the casting chamber 46 through the second supply port 64. Because the molten metal 16 rises in the casting apparatus 10 as the fluid is added to the casting chamber 46, the amount of pressure applied to the molten metal 16 corresponds to the length the molten metal 16 travels into the mold 12. Thus, it will be appreciated that the near maximum amount of pressure applied to the molten metal 16 in the casting chamber 46 occurs when the mold 12 is relatively full of molten metal 16, and the cast article in the mold 12 is near its maximum size. Additional pressure may be applied to the molten metal 16 in the casting chamber 46 to accommodate shrinkage of the molten metal 16 as it cools.

The illustrated desired fill profile 240 can be divided into filling stages, illustrated as stage 1, stage 2, stage 3, and stage 4. The desired fill profile 240 may include any suitable number of stages. The filling stages 1–4 are associated with four time intervals, $t_0$ to $t_1$, $t_1$ to $t_2$, $t_2$ to $t_3$, and $t_3$ to $t_4$, respectfully, and with four pressure change intervals, p0 to p1, p1 to p2, p2 to p3 and p3 to p4. It should be noted that the desired fill profile 240 includes "smooth" transitions from stage 1 to stage 2, from stage 2 to stage 3, and from stage 3 to stage 4. It will be appreciated that the pressure increases at all portions of the illustrated desired fill profile 240 from $t_0$ to $t_4$. It will also be appreciated that the pressure increases faster during stage 1 and stage 3 compared to stage 2 and stage 4.

$P_0$ is representative of the pressure at which the molten metal 16 is optimally delivered to the feed tube 76 (illustrated in FIG. 1). $P_1$ is representative of the pressure at which the molten metal 16 is optimally delivered proximate the inlet feed gate 28. $P_2$ is representative of the pressure at which the molten metal 16 is optimally delivered to the mold cavity 24. $P_3$ is representative of the pressure at which the molten metal 16 is optimally delivered to the mold cavity 24 when the cast article is cooling. $P_4$ is representative of the pressure at the termination of the desired fill profile 240. Likewise, $P_1$, $P_2$, and $P_3$ are the pressures at those portions of the desired fill profile 240 where the rates of pressure change.

The present invention also includes an actual fill profile, indicated generally by dotted line 256. The actual fill profile 256 generally corresponds to the amount of the molten metal 16 in the mold 12 to produce the cast article. The molten metal 16 is delivered to the mold 12 as a controlled amount of the fluid is supplied through the second supply port 64, which in turn cause the molten metal 16 to move upwardly into the mold 12.

The actual fill profile 256 is divided into four different filling stages, illustrated as stage 1, stage 2, stage 3, and stage 4. The actual fill profile 256 may include any suitable number of stages. The filling stages 1–4 are associated with four time intervals, $t_0$ to $t_1$, $t_1$ to $t_2$, $t_2$ to $t_3$, and $t_3$ to $t_4$, respectfully, and with four pressure change intervals, p0 to p1, p1 to p2, p2 to p3 and p3 to p4. It should be noted that the actual fill profile 256 changes from stage 1 to stage 2, from stage 2 to stage 3, and from stage 3 to stage 4.

It will be appreciated that the $P_0$ of the desired fill profile 240 and the $P_0$ of the actual fill profile 256 are about equal. However, it will also be appreciated that, at about a point 268, the pressure of the actual fill profile 256 is less than that of the desired fill profile 240. Between a point 268 and a point 276, the fluid is added to the casting chamber 46 at a first rate. Stage 1 ends at about the point 276 at about time $t_1$. During stage 1, the mold 12 is filled by delivering the molten metal 16 from the casting chamber 46 to the mold 12 at a preselected first rate. In particular, during a relatively straight portion of the actual fill profile 256 in stage 1, the filling of the mold 12 is selectively controlled by introducing the fluid into the casting chamber 46 at the first rate, which allows the molten metal 16 to rise at the first rate. During an acceleration portion of stage 1, the molten metal 16 is accelerated up to the desired fill rate for stage 1. The acceleration portion of stage 1 includes the relatively curved portion of the actual fill profile 256 at about the point 268.

During stage 2, the fluid is added to the casting chamber 46 at a second rate. In particular, during stage 2, the filling of the mold 12 is selectively controlled by introducing the fluid into the casting chamber 46 at a preselected second rate. As is indicated by the steeper slope of the stage 1 portion of the actual fill profile 256 compared to the stage 2 portion, the mold 12 is filling more slowly with molten metal 16 during stage 2. It will be appreciated that the rate at which the mold 12 is filling at a point 280 is less than the rate at which the mold 12 is filling at the point 272. As a result of this, a smooth transition in the filling of the mold cavity 24 occurs at the transition from the end of stage 1 to the beginning of stage 2. Stage 2 ends at about the point 284, at about time $t_2$.

During stage 3, the fluid is added to the casting chamber 46 at a third rate. In particular, during stage 3, the filling of the mold 12 is selectively controlled by introducing the fluid into the casting chamber 46 at the preselected third rate. As is indicated by the steeper slope of the stage 3 portion of the actual fill profile 256 compared to that of the stage 2 portion, the mold 12 is filling more slowly with molten metal 16 during stage 2. It will be appreciated that the rate at which the mold 12 is filling at the point 280 is less than the rate at which the mold 12 is filling at a point 288. Likewise, as discussed above, the transition from stage 2 to stage 3 is a smooth transition. Between the point 280 and a point 284, the fluid is added to the casting chamber 46 at the third rate. Stage 3 ends at about the point 292, at about time $t_3$.

During stage 4, the fluid is added to the casting chamber 46 at a fourth rate. In particular, during stage 4, the filling of the mold 12 is selectively controlled by introducing the fluid into the casting chamber 46 at the preselected fourth rate. Between the point 292 and the point 300, the fluid is added to the casting chamber 46 at the fourth rate. As is indicated by the steeper slope of the stage 3 portion of the actual fill profile 256 compared to that of the stage 4 portion, the mold 12 is filling more slowly with molten metal 16 during stage 4. It will be appreciated that the rate at which the mold 12 is filling at a point 296 is less than the rate at which the mold 12 is filling at the point 288. Likewise, the transition from stage 3 to stage 4 is a smooth transition.

Stage 4 ends at about the point 300 at about time $t_4$. At the point 300, the maximum amount of molten metal 16 to be added to the mold 12 is reached. It should be understood that the slope of the actual fill profile 256 during any particular stage or portions thereof during the mold cavity filling process may vary or be other than illustrated. In general, the lesser slope generally corresponds to a portion of the cast article that desirably is less porous and is a function of the geometry of the cast article.

In accordance with the preferred embodiment of the present invention, the desired fill profile 240 is provided to the casting apparatus 10 by the controller 54. It will be appreciated that the desired fill profile 240 defines a generally rounded command line compared to the command line curve of the prior art desired fill profile 112 illustrated in FIG. 3, particularly around the pressures $P_1$, $P_2$, $P_3$ and $P_4$ at the respective times $t_1$, $t_2$, $t_3$, and $t_4$ of the desired fill profile 240. The generally rounded regions of the command line curve of the desired fill profile 240 around the times $t_1$ and $t_3$ illustrate that the molten metal 16 is gradually decelerating as the molten metal 16 enters the mold 12 at approximately that time. The generally rounded region of the desired fill profile 240 around the time $t_2$ illustrate that the molten metal 16 is gradually accelerating as the molten metal 16 enters the mold 12 at approximately that time. It will be appreciated that the gradually decelerating and gradually accelerating portions of the desired fill profile 240 produces less "overshoots" and "bounces" in the actual fill profile 256 of FIG. 4 compared to the prior art actual fill profile 116 of FIG. 3.

It should be noted that the actual fill profile 256 of FIG. 4 and the prior art actual fill profile 116 of FIG. 3 differ in that the actual fill profile 256 of FIG. 4 does not "overshoot" its corresponding desired fill profile 240. Likewise, the actual fill profile 256 of FIG. 4 does not produce the "bounce" and turbulence illustrated and described above in connection with prior art FIG. 3. Without wishing to be bound by theory, it is believed that the filling method according to the present invention allows the kinetic energy of the molten metal 16 to dissipate in the casting apparatus 10 in a selectively controlled manner. As a result of this, the turbulence is reduced in the filling of the mold 12 with the molten metal 16 according to the present invention.

Figure 5:
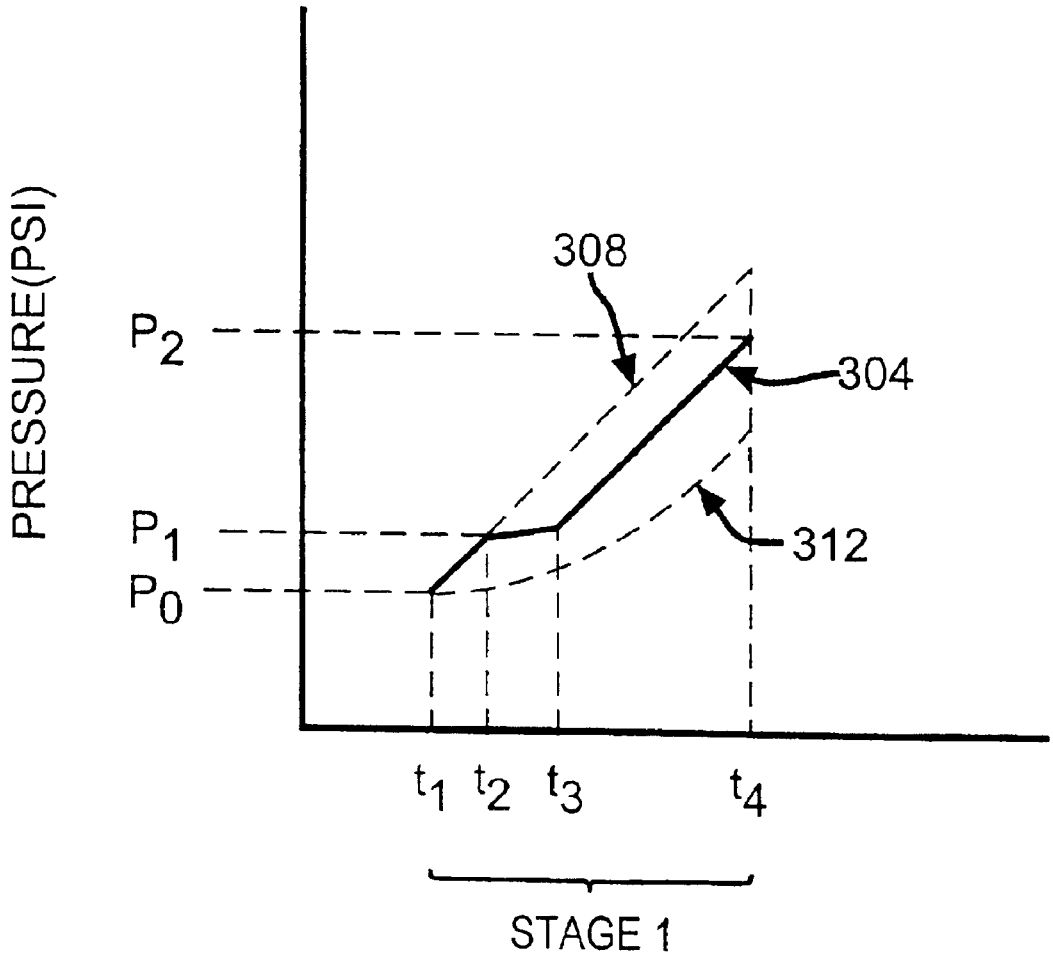
FIG. 5 is another graph illustrating the filling method according to the present invention.

Referring now to FIG. 5, a more desirable cast article may be formed by providing for feedback between the transducer 52 of the casting apparatus 10 and the controller 54. As shown therein, a portion of a desired fill profile is indicated generally at 304. The desired fill profile 304, illustrated in solid line, is a command line or curve, and preferably represents the way in which the molten metal 16 theoretically fills the casting chamber 46, the feed tube 76, and the mold cavity 24 of the mold 12 in order to produce the cast article. The desired fill profile 304 is preferably generated by the controller 54. The illustrated desired fill profile 304 illustrates the desired amounts of the molten metal 16 to be delivered to the mold 12 to produce the cast article. The control variable is the pressure from the fluid that is added to the casting chamber 46 through the second supply port 64.

The illustrated desired fill profile 304 can be divided into one or more filling stages, each filling stage corresponding to a selected time interval. Stage 1 of the desired fill profile 304 is illustrated. It should be understood that the invention may be practiced at any suitable stage of the desired fill profile 304. Between the time $t_1$ and the time $t_2$, the desired fill profile 304 indicates that the molten metal 16 is optimally moved at a first rate of pressure. Between the time $t_2$ and the time $t_3$, the desired fill profile 304 indicates that the molten metal 16 is optimally moved at a second rate of pressure. Between the time $t_3$ and the time $t_4$, the desired fill profile 304 indicates that the molten metal 16 is optimally moved at a third rate of pressure. It will be appreciated that a dotted line 308 is shown and is representative of how the molten metal 16 is moved at the first rate of pressure, if the desired fill profile 304 does not change at the time $t_2$. The dotted line is approximately collinear with the portion of the desired fill profile 304 between the time $t_1$ and the time $t_2$.

FIG. 5 also illustrates an actual fill profile or command line, indicated generally at 312, which generally corresponds to the amount of molten metal 16 in the mold 12 to produce the cast article. The molten metal 16 is delivered to the mold 12 as a controlled amount of the fluid and is supplied through the second supply port 64, which in turn moves the molten metal 16 upwardly into the mold 12. The actual fill profile 312 can be divided into one or more filling stages, each filling stage corresponding to a selected time interval. Stage 1 of the actual fill profile 312 is illustrated in FIG. 5.

Between the time $t_1$ and the time $t_2$, the position of the actual fill profile 312 indicates that the mold 12 is filling at a rate slower than the first rate of pressure prescribed by the desired fill profile 304 during the same time period. The transducer 52 detects the pressure in the casting chamber 46 and those portions of the casting apparatus 10 in fluid communication with the casting chamber 46. At about the time $t_2$, the transducer 52 sends a signal representative of the pressure in the casting chamber 46 and those portions of the casting apparatus 10 in fluid communication with the casting chamber 46 to the controller 54. At about the time $t_2$, the controller 54 responds by changing the desired fill profile 304. The desired fill profile 304 is changed in that the desired fill profile 304 does not continue at the first rate of pressure. Instead, the desired fill profile 304 is changed to move the molten metal 16 at the selected second rate of pressure.

It should be understood that the slope of the actual fill profile 312 during any particular stage or portion or the filling process may vary. In general, the lesser slope generally corresponds to a portion of the cast article that desirably is less porous and is a function of the geometry of the cast article.

It should be noted that the actual fill profile 312 of FIG. 5 and the actual fill profile 116 of FIG. 3 differ in that the actual fill profile 312 of FIG. 5 does not "overshoot" its corresponding desired fill profile 304. Likewise, the actual fill profile 312 of FIG. 5 does not produce the "bounce" and turbulence noted in FIG. 3. Without wishing to be bound by theory, it is believed that the filling method according to the invention allows the kinetic energy of the molten metal 16 to dissipate in the casting apparatus 10 in a controlled manner. This reduces the turbulence in the filling of the mold 12 with the molten metal 16.

The principle and mode of operation of this invention have been described in its preferred embodiments. However, it should be noted that this invention may be practiced otherwise than as specifically illustrated and described without departing from its scope.

We claim:

1. A method for filling a mold by a desired fill profile having at least four filling stages, stage 1, stage 2, stage 3 and stage 4, associated with four time intervals, $t_0$ to $t_1$, $t_1$ to $t_2$, $t_2$ to $t_3$, and $t_3$ to $t_4$, respectfully, and with four pressure change intervals, $P_0$ to $P_1$, $P_1$ to $P_2$, $P_2$ to $P_3$ and $P_3$ to $P_4$, respectively, to make a cast article comprising the steps of:

(a) providing a molten metal to a casting chamber in fluid communication with the mold, the casting chamber having a supply conduit for introducing a gas into the casting chamber, and the casting chamber having an evacuation conduit for delivering the molten metal from the casting chamber to the mold;

(b) controlling the filling of the mold during the first time interval $t_0$ to $t_1$ of stage 1 by delivering the molten metal from the casting chamber to the mold at a first rate by supplying the gas to the casting chamber during stage 1 at to at $P_0$ and at $t_1$ at $P_1$ to allow the molten metal to rise at the first rate, stage 1 including an acceleration portion wherein the molten metal is accelerated up to a desired fill rate for stage 1, the first rate operative to produce a first stage actual fill profile;

(c) controlling the filling of the mold during the second time interval $t_1$ to $t_2$ of stage 2 by delivering the molten metal from the casting chamber to the mold at a second rate by supplying the gas to the casting chamber during stage 2 at $t_1$ at $P_1$ and at $t_2$ at $P_2$ to allow the molten metal to rise at the second rate, the second rate operative to produce a second stage actual fill profile, the second rate being less than the first rate to thereby prevent the actual fill profile during the transition from the end of the first stare actual fill profile to the beginning of the second stage actual fill profile from overshooting the desired fill profile and causing the molten metal to bounce and create turbulence in the mold whereby the mold fills more slowly with molten metal during stage 2 than during stage 1 to thereby produce a smooth transition in the filling of the mold cavity indicated graphically by a gradually decreasing slope value during the transition from the end of stage 1 to the beginning of stage 2;

(d) controlling the filling of the mold during the third time interval $t_2$ to $t_3$ of stage 3 by delivering the molten metal from the casting chamber to the mold at a third rate by supplying the gas to the casting chamber during stage 3 at $t_2$ at $P_2$ and at $t_3$ at $P_3$ to allow the molten metal to rise at the third rate, the third rate being greater than the second rate whereby the mold fills more quickly with molten metal during stage 3 than during stage 2, the third rate operative to produce a third stage actual fill profile; and (e) controlling the filling of the mold during the fourth time interval $t_3$ to $t_4$ of stage 4 by delivering the molten metal from the casting chamber to the mold at a fourth rate by supplying the gas to the casting chamber during stage 4 at $t_3$ at $P_3$ and at $t_4$ at $P_4$ to allow the molten metal to rise at the fourth rate, the fourth rate operative to produce a fourth stage actual fill profile, the fourth rate being less than the third rate to thereby prevent the actual fill profile during the transition from the end of the third stage actual fill profile to the beginning of the fourth stage actual fill profile from overshooting the desired fill profile and causing the molten metal to bounce and create turbulence in the mold whereby the mold fills more slowly with molten metal during stage 4 than during stage 3 to thereby produce a smooth transition in the filling of the mold cavity indicated graphically by a gradually decreasing slope value during the transition from the end of stage 3 to the beginning of stage 4.

2. The method of claim 1 further comprising the step of providing a controller for controlling filling of the mold during the at least four filling stages.

3. A method for filling a mold by a desired fill profile having at least four filling stages, stage 1, stage 2, stage 3 and stage 4, associated with four time intervals, $t_0$ to $t_1$, $t_1$ to $t_2$, $t_2$ to $t_3$, and $t_3$ to $t_4$, respectfully, and with four pressure change intervals, $P_0$ to $P_1$, $P_1$ to $P_2$, $P_2$ to $P_3$ and $P_3$ to $P_4$, respectively, to make a cast article comprising the steps of:

(a) providing a molten metal to a casting chamber in fluid communication with the mold, the casting chamber having a supply conduit for introducing a gas into the casting chamber, and the casting chamber having an evacuation conduit for delivering the molten metal from the casting chamber to the mold;

(b) providing a transducer and a controller;

(c) controlling the filling of the mold during the first time interval $t_0$ to $t_1$ of stage 1 by delivering the molten metal from the casting chamber to the mold at a first rate by supplying the gas to the casting chamber during stage 1 at to at $P_0$ and at $t_1$ at $P_1$ to allow the molten metal to rise at the first rate, stage 1 including an acceleration portion wherein the molten metal is accelerated up to a desired fill rate for stage 1, the first rate operative to produce a first stage actual fill profile;

(d) controlling the filling of the mold during the second time interval $t_1$ to $t_2$ of stage 2 by delivering the molten metal from the casting chamber to the mold at a second rate by supplying the gas to the casting chamber during stage 2 at $t_1$ at $P_1$ and at $t_2$ at $P_2$ to allow the molten metal to rise at the second rate, the second rate operative to produce a second stage actual fill profile, the second rate being less than the first rate to thereby prevent the actual fill profile at the transition from the end of the first stage actual fill profile to the beginning of the second stage actual fill profile from overshooting the desired fill profile and causing the molten metal to bounce and create turbulence in the mold whereby the mold fills more slowly with molten metal during stage 2 than during stage 1 to thereby produce a smooth transition in the filling of the mold cavity indicated graphically by a gradually decreasing slope value during the transition from the end of stage 1 to the beginning of stage 2;

(e) controlling the filling of the mold during the third time interval $t_2$ to $t_3$ of stage 3 by delivering the molten metal from the casting chamber to the mold at a third rate by supplying the gas to the casting chamber during stage 3 at $t_2$ at $P_2$ and at $t_3$ at $P_3$ to allow the molten metal to rise at the third rate, the third rate being greater than the second rate whereby the mold fills more quickly with molten metal during stage 3 than during stage 2, the third rate operative to produce a third stage actual fill profile; and (f) controlling the filling of the mold during the fourth time interval $t_3$ to $t_4$ of stage 4 by delivering the molten metal from the casting chamber to the mold at a fourth rate by supplying the gas to the casting chamber during stage 4 at $t_3$ at $P_3$ and at $t_4$ at $P_4$ to allow the molten metal to rise at the fourth rate, the fourth rate operative to produce a fourth stage actual fill profile, the fourth rate being less than the third rate to thereby prevent the actual fill profile at the transition from the end of the third stage actual fill profile to the beginning of the fourth stage actual fill profile from overshooting the desired fill profile and causing the molten metal to bounce and create turbulence in the mold whereby the mold fills more slowly with molten metal during stage 4 than during stage 3 to thereby produce a smooth transition in the filling of the mold cavity indicated graphically by a gradually decreasing slope value during the transition from the end of stage 3 to the beginning of stage 4;

wherein the transducer sends signals representative of the pressures in the casting chamber to the controller and the controller changes the filling of the mold from the first rate to the second rate to the third rate and to the fourth rate.

4. A method for filling a mold by a desired fill profile having at least four filling stages, stage 1, stage 2, stage 3 and stage 4, associated with four time intervals, $t_0$ to $t_1$, $t_1$ to $t_2$, $t_2$ to $t_3$, and $t_3$ to $t_4$, respectfully, and with four pressure change intervals, $P_0$ to $P_1$, $P_1$ to $P_2$, $P_2$ to $P_3$ and $P_3$ to $P_4$, respectively, to make a cast article comprising the steps of:

(a) providing a molten metal to a casting chamber, the casting chamber having a supply conduit for introducing a gas into the casting chamber, and the casting chamber having an evacuation conduit for delivering the molten metal from the casting chamber to the mold;

(b) providing a desired fill profile for delivering the molten metal from the casting chamber to the mold;

(c) detecting the pressure in the casting chamber;

(d) providing a controller and sending a signal representative of the pressure in the casting chamber to the controller; and (e) changing the desired fill profile based upon the signal representative of the pressure in the casting chamber;

wherein the desired fill profile includes at least controlling the filling of the mold during the first time interval $t_0$ to $t_1$ of stage 1 by delivering the molten metal from the casting chamber to the mold at a first rate by supplying the gas to the casting chamber during stage 1 at $t_0$ at $P_0$ and at $t_1$ at $P_1$ to allow the molten metal to rise at the first rate, stage 1 including an acceleration portion wherein the molten metal is accelerated up to a desired fill rate for stage 1, the first rate operative to produce a first stage actual fill profile, controlling the filling of the mold during the second time interval $t_1$ to $t_2$ of stage 2 by delivering the molten metal from the casting chamber to the mold at a second rate by supplying the gas to the casting chamber during stage 2 at $t_1$ at $P_1$ and at $t_2$ at $P_2$ to allow the molten metal to rise at the second rate, the second rate operative to produce a second stare actual fill profile, the second rate being less than the first rate to thereby prevent the actual fill profile at the transition from the end of the first stage actual fill profile to the beginning of the second stage actual fill profile from overshooting the desired fill profile and causing the molten metal to bounce and create turbulence in the mold whereby the mold fills more slowly with molten metal during stage 2 than during stage 1 to thereby produce a smooth transition in the filling of the mold cavity indicated graphically by a gradually decreasing slope value during the transition from the end of stage 1 to the beginning of stage 2; controlling the filling of the mold during the third time interval $t_2$ to $t_3$ of stage 3 by delivering the molten metal from the casting chamber to the mold at a third rate by supplying the gas to the casting chamber during stage 3 at $t_2$ at $P_2$ and at $t_3$ at $P_3$ to allow the molten metal to rise at the third rate, the third rate being greater than the second rate whereby the mold fills more quickly with molten metal during stage 3 than during stage 2, the third rate operative to produce a third stage actual fill profile; and controlling the filling of the mold during the fourth time interval $t_3$ to $t_4$ of stage 4 by delivering the molten metal from the casting chamber to the mold at a fourth rate by supplying the gas to the casting chamber during stage 4 at $t_3$ at $P_3$ and at $t_4$ at $P_4$ to allow the molten metal to rise at the fourth rate, the fourth rate operative to produce a fourth stage actual fill profile, the fourth rate being less than the third rate to thereby prevent the actual fill profile at the transition from the end of the third stage actual fill profile to the beginning of the fourth stage actual fill profile from overshooting the desired fill profile and causing the molten metal to bounce and create turbulence in the mold whereby the mold fills more slowly with molten metal during stage 4 than during stage 3 to thereby produce a smooth transition in the filling of the mold cavity indicated graphically by a gradually decreasing slope value during the transition from the end of stage 3 to the beginning of stage 4.

5. The method of claim 4 further comprising the step of providing a transducer to detect the pressures in the casting chamber.

6. A method for filling a mold by a desired fill profile having at least two filling stages, stage 1 and stage 2, associated with two time intervals, $t_0$ to $t_1$ and $t_1$ to $t_2$, respectfully, and with two pressure change intervals, $P_0$ to $P_1$, and $P_1$ to $P_2$, respectively, to make a cast article comprising the steps of:

(a) providing a molten metal to a casting chamber in fluid communication with the mold, the casting chamber having a supply conduit for introducing a gas into the casting chamber, and the casting chamber having an evacuation conduit for delivering the molten metal from the casting chamber to the mold;

(b) controlling the filling of the mold during the first time interval $t_0$ to $t_1$ of stage 1 by delivering the molten metal from the casting chamber to the mold at a first rate by supplying the gas to the casting chamber during stage 1 at to at $P_0$ and at $t_1$ at $P_1$ to allow the molten metal to rise at the first rate, stage 1 including an acceleration portion wherein the molten metal is accelerated up to a desired fill rate for stage 1, the first rate operative to produce a first stage actual fill profile; and (c) controlling the filling of the mold during the second time interval $t_1$ to $t_2$ of stage 2 by delivering the molten metal from the casting chamber to the mold at a second rate by supplying the gas to the casting chamber during stage 2 at $t_1$ at $P_1$ and at $t_2$ at $P_2$ to allow the molten metal to rise at the second rate, the second rate operative to produce a second stage actual fill profile, the second rate being less than the first rate to thereby prevent the actual fill profile during the transition from the end of the first stage actual fill profile to the beginning of the second stage actual fill profile from overshooting the desired fill profile and causing the molten metal to bounce and create turbulence in the mold whereby the mold fills more slowly with molten metal during stage 2 than during stage 1 to thereby produce a smooth transition in the filling of the mold cavity indicated graphically by a gradually decreasing slope value during the transition from the end of stage 1 to the beginning of stage 2.

7. The method of claim 6 further comprising the step of providing a controller for controlling filling of the mold during the at least two filling stages.

8. The method of claim 6 further comprising the step of providing a transducer to detect the pressures in the casting chamber.

9. The method of claim 6 further comprising the steps of providing a controller for controlling filling of the mold during the at least two filling stages and providing a transducer to detect the pressures in the casting chamber.

* * * * *

UNITED STATES PATENT AND TRADEMARK OFFICE

CERTIFICATE OF CORRECTION

PATENT NO. : 6,779,588 B1
DATED : August 24, 2004
INVENTOR(S) : Dave Good, et al.

It is certified that error appears in the above-identified patent and that said Letters Patent is hereby corrected as shown below:

Column 12,
Line 32 delete "at to" and insert -- as $t_0$ --;
Line 46, delete "stare" and insert -- stage --.

Column 13,
Line 38, delete "at to" and insert -- as $t_0$ --.

Column 16,
Line 11, delete "at to" and insert -- as $t_0$ --.

Signed and Sealed this

Fourteenth Day of December, 2004

JON W. DUDAS
*Director of the United States Patent and Trademark Office*